US010508242B2

(12) United States Patent
Diefenthal et al.

(10) Patent No.: US 10,508,242 B2
(45) Date of Patent: Dec. 17, 2019

(54) VAPOR PHASE HYDROCARBON EXTRACTION OF OIL FROM OIL SAND

(75) Inventors: Edward L. Diefenthal, Metairie, LA (US); Richard D. Jordan, Vienna, VA (US); Richard H. Schlosberg, Highland Park, IL (US)

(73) Assignee: EPIC OIL EXTRACTORS, LLC, Ponchatoula, LA (US)

( * ) Notice: Subject to any disclaimer, the term of this patent is extended or adjusted under 35 U.S.C. 154(b) by 1296 days.

(21) Appl. No.: 13/420,373

(22) Filed: Mar. 14, 2012

(65) Prior Publication Data

US 2012/0261313 A1 Oct. 18, 2012

Related U.S. Application Data

(63) Continuation-in-part of application No. 13/273,003, filed on Oct. 13, 2011.

(60) Provisional application No. 61/392,652, filed on Oct. 13, 2010.

(51) Int. Cl.
*C10G 1/04* (2006.01)

(52) U.S. Cl.
CPC ..... *C10G 1/045* (2013.01)

(58) Field of Classification Search
USPC ..... 208/390, 391
See application file for complete search history.

(56) References Cited

U.S. PATENT DOCUMENTS

| | | | | |
|---|---|---|---|---|
| 2,281,865 | A | 5/1942 | Van Dijck | |
| 2,670,317 | A * | 2/1954 | Adams | C10G 1/002 208/390 |
| 3,459,653 | A | 8/1969 | Benson | |
| 3,475,279 | A * | 10/1969 | Bowman | C10B 47/40 201/32 |
| 3,475,318 | A | 10/1969 | Gable et al. | |
| 3,542,666 | A | 11/1970 | Simpson | |
| 4,036,732 | A | 7/1977 | Irani et al. | |
| 4,174,263 | A * | 11/1979 | Veatch | C10G 1/04 208/390 |
| 4,189,376 | A | 2/1980 | Mitchell | |
| 4,347,117 | A | 8/1982 | Bauman et al. | |
| 4,572,777 | A | 2/1986 | Peck | |
| 4,596,651 | A | 6/1986 | Wolff et al. | |
| 4,676,889 | A * | 6/1987 | Hsieh | C10G 1/006 208/390 |
| 7,384,557 | B2 * | 6/2008 | Phillips | C10G 1/04 196/14.52 |
| 7,985,333 | B2 | 7/2011 | Duyvesteyn | |
| 8,728,306 | B2 | 5/2014 | Ploemen et al. | |
| 8,741,144 | B2 | 6/2014 | Phillips et al. | |
| 8,771,502 | B2 | 7/2014 | Blackbourn et al. | |
| 2006/0076274 | A1 | 4/2006 | Duyvesteyn et al. | |
| 2008/0190814 | A1 | 8/2008 | Caneba et al. | |
| 2009/0288994 | A1 | 11/2009 | Kuznicki et al. | |
| 2009/0294332 | A1 | 12/2009 | Ryu | |
| 2010/0130386 | A1 * | 5/2010 | Chakrabarty | 507/103 |

FOREIGN PATENT DOCUMENTS

WO 2007146992 A2 12/2007

OTHER PUBLICATIONS

PCT/US2011/056191, PCT International Search Report, Form PCT/ISA/210, dated May 29, 2012, 3 pgs.

PCT/US2011/056191, PCT Written Opinion of the International Searching Authority, Form PCT/ISA/237, dated May 29, 2012, 5 pgs.

* cited by examiner

*Primary Examiner* — Michelle Stein
(74) *Attorney, Agent, or Firm* — William H. Honaker; Dickinson Wright PLLC

(57) ABSTRACT

This invention provides a process for producing a crude oil composition from oil sand using a solvent comprised of a hydrocarbon mixture to extract or remove only a portion of the bitumen on the oil sand. The solvent type and the manner by which the extraction process is carried out has substantial impact on the quality of the extracted oil component. The solvent is designed so that it has the desired Hansen solubility parameters that enable the partial extraction of the desired oil composition. The solvent is further designed so that it can be comprised of multiple hydrocarbons having the appropriate boiling point ranges that enable the solvent to be easily recovered and recycle, without the need to externally provide for solvent make-up.

11 Claims, No Drawings

VAPOR PHASE HYDROCARBON EXTRACTION OF OIL FROM OIL SAND

CROSS-REFERENCE TO PRIOR APPLICATIONS

This application is a Continuation-in-Part of U.S. application Ser. No. 13/273,003, filed Oct. 13, 2011, which claims the benefit of U.S. Provisional Application Ser. No. 61/392,852, filed Oct. 13, 2010, which is incorporated by reference in its entirety.

FIELD OF THE INVENTION

This invention relates to a process for removing oil from oil sand. In particular, this invention relates to a process for removing a portion of the bitumen oil from oil sand using a hydrocarbon solvent comprised of a mixture of hydrocarbons in which oil that is removed from the oil sand is relatively low in metals and asphaltenes content.

BACKGROUND OF THE INVENTION

Today, most of the heavy hydrocarbon oil produced from Canadian oil sands (known as bitumen), in particular, Athabasca oil sands, is obtained via surface mining followed by extraction with a water-based system built on a discovery made in the 1920s and known as the Clark process. Upon extraction of the bitumen, a frothy water-hydrocarbon mixture must be separated. Thereafter, the hydrocarbon product obtained is too viscous to pump and is frequently diluted with an organic material to render a bitumen-solvent blend (also known as dilbit or synbit) pumpable. This bitumen-solvent is pumped, i.e., pipelined, directly to a facility for upgrading to the desired product mix, e.g., liquid fuel such as jet fuel, diesel and gasoline. The Clark process, despite many decades of process improvement work, remains energy intensive and is environmentally detrimental in that it requires significant quantities of water that must be cleaned for re-use, and generates significant bottoms components that contain high levels of fines (also referred to as tailings or tailings fluid fines).

Tailings fluid fines from the water-based Clark extraction of bitumen from Canadian oil sands require long-term storage before they can become trafficable and suitable for reclamation. The Energy Resources Conservation Board (ERCB) of the Canadian province of Alberta has noted in Directive 074 (February, 2009) that "in past applications, mineable oil sands operators proposed the conversion of fluid tailings into deposits that would become trafficable and ready for reclamation. While operators have applied fluid tailings reduction technologies, they have not met the targets set out in their applications; as a result, the inventories of fluid tailings that require long-term containment have grown. With each successive application and approval, public concerns have grown." In one region of interest, in Alberta, Canada, there are already several huge operations using this technology wherein the water requirements are supplied by the Athabasca River.

In spite of the environmental concerns of using the water-based Clark extraction process, there is additional consideration of importing into the U.S. greater quantities of the bitumen-solvent blend product produced from the process. Currently under consideration is a proposed pipeline that would connect oil resources in Alberta, Canada, to refineries on the Texas coast. As reported in http://www.n-pnorg/2011/09/01/140117187/for-protesters-keystone-pipeline-is-line-in-tar-sand, "The 1,700-mile long Keystone XL, as it's called, would help our friendly northern neighbor expand development in one of the largest, but dirtiest, sources of oil on the planet. It's bound up in hardened formations called tar sands, and it's not easy to extract."

Due to the many environmental concerns in extracting and transporting bitumen from oil sands, replacement of the water-based Clark extraction process with hydrocarbon-based solvents has been investigated. The attractive nature of using a hydrocarbon-based solvent is that little if any water would be needed in such a process.

U.S. Patent Pub. No. 2009/0294332 discloses, for example, an oil extraction process that uses an extraction chamber and a hydrocarbon solvent rather than water to extract the oil from oil sand. The solvent is sprayed or otherwise injected onto the oil-bearing product, to leach oil out of the solid product resulting in a composition comprising a mixture of oil and solvent, which is conveyed to an oil-solvent separation chamber.

U.S. Pat. No. 3,475,318 discloses extracting tar low in asphalenes from a tar sand that contains asphaltenes The tar sand is treated with a saturated hydrocarbon solvent having from 5 to 9 carbon atoms per molecule or with a solvent containing saturated hydrocarbons having from 5 to 9 carbon atoms per molecule and up to 20 percent aromatics having 6 to 9 carbon atoms per molecule. Treatment can be carried out using a variety of filters, such as a continuous belt filter, moving pan filter or rotary pan filter. The treated tar sand is steam stripped to remove solvent from the treated tar sand.

U.S. Pat. No. 4,347,118 discloses a solvent extraction process for tar sands wherein a low boiling solvent having a normal boiling point of from 20° to 70° C. is used to extract tar sands. The solvent is mixed with tar sands in a dissolution zone, the solvent:bitumen weight ratio is maintained from about 0.5:1 to 2:1. This mixture is passed to a separation zone in which bitumen and inorganic fines are separated from extracted sand, the separation zone containing a classifier and countercurrent extraction column. The extracted sand is introduced into a first fluid-bed drying zone fluidized by heated solvent vapors, so as to remove unbound solvent from extracted sand while at the same time lowering the water content of the sand to less than about 2 wt %. The treated sand is then passed into a second fluid-bed drying zone fluidized by a heated inert gas to remove bound solvent. Recovered solvent is recycled to the dissolution zone.

U.S. Patent Pub. No. 2010/0130386 discloses the use of a solvent for bitumen extraction. The solvent includes (a) a polar component, the polar component being a compound comprising a non-terminal carbonyl group; and (b) a non-polar component, the non-polar component being a substantially aliphatic substantially non-halogenated alkane. The solvent has a Hansen hydrogen bonding parameter of 0.3 to 1.7 and/or a volume ratio of (a):(b) in the range of 10:90 to 50:50.

U.S. Patent Pub. No. 2011/0094961 discloses a process for separating a solute from a solute-bearing material. The solute can be bitumen and the solute-bearing material can be oil sand. A substantial amount of the bitumen can be extracted from the oil sand by contacting particles of the oil sand with globules of a hydrocarbon extraction solvent. The hydrocarbon extraction solvent is a $C_1$-$C_5$ hydrocarbon. The particle size of the oil sand and the globule size of the extraction solvent are balanced such that little if any bitumen or extraction solvent remains in the oil sand.

Although hydrocarbon extraction processes provide an advantage in that water is not used in the extraction of the oil from the oil sand, thereby reducing a portion of the environmental impact, problems in using hydrocarbon-based extractions persist. For example, disclosed processes have typically relied on solvents that are substantially pure hydrocarbons. Since there is at least some solvent loss during extraction, additional quantities of the solvent have to be obtained externally, which substantially adds to the overall cost of obtaining the desired crude oil product. In addition, disclosed processes have generally been demonstrated to extract all or substantially all of the bitumen from the oil sand. This results in a crude oil product that is extremely viscous, high in undesirable metals and asphaltenes content and is rather difficult to pipeline and upgrade to fuel grade products. Although use of hydrocarbon solvents can recover substantial amounts of the bitumen, the resulting crude composition, which also comprises the hydrocarbon solvent, is substantially similar to the current dilbit or synbit. Such a product will not necessarily allay the concerns of pipelining the product through the proposed Keystone XL.

SUMMARY OF THE INVENTION

This invention provides a process for producing an oil composition from oil sand that requires little to no water to produce the oil composition. The process is particularly environmentally attractive in that the ultimate crude oil that is pipelined is substantially higher in quality than existing crude oils from oil sand. In addition, the process does not produce substantial quantities of undesirable tailings. Therefore, the invention provides a process for producing a higher quality oil composition, with substantially lower environmental impact, than has been previously achieved. A further advantage of the invention is that the particular solvent that is used to remove or extract the oil composition from the oil sand can be easily recovered from the process itself. Thus, little to no external solvent make-up is required.

According to one aspect of the invention, there is provided a process for producing a crude oil composition from oil sand that uses a solvent comprised of a hydrocarbon mixture. The solvent is injected into a vessel and the oil sand is supplied to the vessel such that the solvent and oil sand contact one another in the vessel, i.e., contact zone of the vessel. The process is carried out such that not greater than 80 wt % of the bitumen is removed from the supplied oil sand, with the removal being controlled by the Hansen solubility blend parameters of the solvent and the vapor condition of the solvent in the contact zone. The extracted oil and at least a portion of the solvent are removed from the vessel for further processing as may be desired.

The solvent can have a Hansen dispersion blend parameter of not greater than 16 and/or a Hansen polarity blend parameter of not greater than 2.5, preferably not greater than 2. Especially desired solvents that comprise blends of hydrocarbons would have a Hansen dispersion blend parameter of not greater than 16 and a Hansen polarity blend parameter of not greater than 2.5, preferably not greater than 2. In addition, solvents further including a Hansen hydrogen bonding blend parameter of not greater than 2 are particularly preferred.

The contacting of the oil sand and the solvent in the vessel can be at a temperature of at least −45° C. Correspondingly, the contacting of the oil sand and the solvent in the vessel can be at a pressure of not greater than 600 psia (4137 kPa).

The solvent can also be defined according to boiling point in which the solvent has an ASTM D86 10% distillation point of at least −45° C. and an ASTM D86 90% distillation point of not greater than 300° C. Alternatively, the solvent can have an ASTM D86 10% distillation point within the range of from −45° C. to 50° C. and an ASTM D86 90% distillation point of not greater than 300° C. The solvent can also have a difference of at least 10° C. between its ASTM D86 90% distillation point and its ASTM D86 10% distillation point, preferably not greater than 60° C.

The solvent can further have an aromatic content of not greater than 15 wt %. Additionally, the solvent can have a ketone content of not greater than 20 wt %. It is desired that the solvent be comprised of not greater than 20 wt % non-hydrocarbon compounds.

The solvent and oil sand can be supplied to the contact zone of the extraction vessel at a weight ratio of total hydrocarbon in the solvent to oil sand feed of at least 0.01:1, preferably not greater than 4:1.

A fraction of the crude oil composition is separated and recycled to the vessel as make-up solvent.

DETAILED DESCRIPTION OF THE INVENTION

I. Introduction

This invention provides a process for producing a crude oil composition from oil sand using a solvent comprised of a hydrocarbon mixture oil sand. The oil sand, which contains bitumen, is supplied to an appropriate extraction vessel, with the solvent being injected into the vessel. In the vessel, i.e., contact zone of the vessel, the oil sand is contacted with the solvent to produce a crude oil composition. The crude oil composition is comprised of an extracted portion of the bitumen and at least a portion of the solvent. The extracted portion of the bitumen is less than the complete quantity of bitumen on the oil sand. The advantage in extracting only a portion of the bitumen is that a relatively high quality crude oil can be obtained that has fewer undesirable components. Significant quantities of these undesirable components, such as metals and asphaltenes, can remain with the unextracted bitumen component.

The solvent type and the manner by which the extraction process is carried out has substantial impact on the quality of the extracted oil component. The solvent is designed so that it has the desired Hansen solubility parameters that enable the partial extraction of the desired oil composition. The solvent is further designed so that it can be comprised of multiple hydrocarbons having the appropriate boiling point ranges that enable the solvent to be easily recovered and recycled, without the need to externally provide for any significant solvent make-up. The ultimate crude product that can be recovered is a high quality crude having low metals and asphaltenes. This high quality product can be relatively easily pipelined and/or upgraded to liquid fuels compared to typical crude products. Since the process does not require the use of water, the process does not produce substantial quantities of undesirable tailings, and the environmental impact of the oil recovery is substantially reduced.

II. Oil Sand

Oil can be extracted from any oil sand according to this invention. The oil sand can also be referred to as tar sand or bitumen sand. Additionally, the oil sand can be characterized as being comprised of a porous mineral structure, which contains an oil component. The entire oil content of the oil sand can be referred to as bitumen. Bitumen can be comprised of numerous oil components. For example, bitumen can be comprised of a flowable oil component, various volatile hydrocarbons and various non-volatile hydrocarbons, such as asphaltenes. Oil sand can be relatively soft and free flowing, or it can be very hard or rock-like, while the bitumen content may vary over a wide range.

One example of an oil sand from which an oil composition, including bitumen, can be extracted according to this invention can be referred to as water wet oil sand, such as that generally found in the Athabasca deposit of Canada. Such oil sand can be comprised of mineral particles surrounded by an envelope of water, which may be referred to as connate water. The bitumen of such water wet oil sand may not be in direct physical contact with the mineral particles, but rather formed as a relatively thin film that surrounds a water envelope around the mineral particles.

Another example of oil sand from which an oil composition, including bitumen, can be extracted according to this invention can be referred to as oil wet oil sand, such as that generally found in Utah. Such oil sand may also include water. However, these materials may not include a water envelope barrier between the bitumen and the mineral particles. Rather, the oil wet oil sand can comprise bitumen in direct physical contact with the mineral component of the oil sand.

The process of this invention includes a step of supplying a feed stream of oil sand to a contact zone, with the oil sand being comprised of at least 2 wt % of a total oil composition, based on total weight of the supplied oil sand. Preferably, the oil sand feed is comprised of at least 4 wt % of a total oil composition, more preferably at least 6 wt % of a total oil composition, still more preferably at least 8 wt % of a total oil composition, based on total weight of the oil sand feed.

The total oil or bitumen content of the solute-bearing material is preferably measured according to the Dean-Stark method (ASTM D95-05e1 Standard Test Method for Water in Petroleum Products and Bituminous Materials by Distillation). The Dean-Stark method can be used to determine the weight percent of oil in an oil sand sample as well as water content. A sample is first weighed, then solute is extracted using solvent. The sample and solvent are refluxed under a condenser using a standard Dean-Stark apparatus. Water (e.g., water extracted from sample along with solute) and organic material (e.g., solvent and extracted solute) condense to form two phases in the condenser. The two layers can be separated and weight percent of water and solute can be determined according to the standard method.

Oil sand can have a tendency to clump due to some stickiness characteristics of the oil component of the oil sand. The oil sand that is fed to the contact zone should not be stuck together such that the oil sand can freely flow through the contact zone or such that extraction of the oil component in the contact zone is not significantly impeded. In one embodiment, the oil sand that is provided or fed to the contact zone has an average particle size of not greater than 20,000 microns. Alternatively, the oil sand that is provided or fed to the contact zone has an average particle size of not greater than 10,000 microns, or not greater than 5,000 microns, or not greater than 2,500 microns.

As a practical matter, the particle size of the oil sand feed material should not be extremely small. For example, it is preferred to have an average particle size of at least 100 microns. However, the process of this invention is also particularly suited to treatment of oil sand that is of relatively small diameter. The separated solid material can also be referred to as fine tailings. Fine tailings can be effectively separated from the product. These fine tailings will also be of low environmental impact, since they can be separated in a relatively dry state and deposited as a substantially non-hazardous solid waste material.

III. Solvent Characteristics

The solvent used according to this invention is comprised of a hydrocarbon mixture. The mixture can be comprised of at least two, or at least three or at least four different hydrocarbons. Hydrocarbon according to this invention refers to any chemical compound that is comprised of at least one hydrogen and at least one carbon atom covalently bonded to one another (C—H). Preferably, the solvent is comprised of at least 40 wt % hydrocarbon. Alternatively, the solvent is comprised of at least 60 wt % hydrocarbon, or at least 80 wt % hydrocarbon, or at least 90 wt % hydrocarbon.

The solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the solvent is carried out as a vapor state treatment. For example, at least a portion of the solvent in the vessel that serves as a contact zone for the solvent and oil sand is in the vapor state. In one embodiment, at least 20 wt % of the solvent in the contact zone is in the vapor state. Alternatively, at least 40 wt %, or at least 60 wt %, or at least 80 wt % of the solvent in the contact zone is in the vapor state.

The hydrocarbon of the solvent can be comprised of a mix of hydrocarbon compounds. The hydrocarbon compounds can range from 1 to 30 carbon atoms. In an alternative embodiment, the hydrocarbon of the solvent is comprised of a mixture of hydrocarbon compounds having from 1 to 20, alternatively from 1 to 15, carbon atoms. Examples of such hydrocarbons include aliphatic hydrocarbons, olefinic hydrocarbons and aromatic hydrocarbons. Particular aliphatic hydrocarbons include paraffins as well as halogen-substituted paraffins. Examples of particular paraffins include, but are not limited to propane, butane and pentane. Examples of halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins.

The hydrocarbon component of the solvent can be selected according to the degree of oil component that is desired to be extracted from the oil sand feed. The degree of extraction can be determined according to the amount of bitumen that remains with the oil sand following treatment or extraction. This can be determined according to the Dean Stark process. In another aspect, the degree of extraction can be determined according to the asphaltenes content of the extracted oil compositions. Asphaltenes content can be determined according to ASTM D6560-00(2005) Standard Test Method for Determination of Asphaltenes (Heptane Insolubles) in Crude Petroleum and Petroleum Products. In general, the lower the amount of asphaltenes in the crude oil composition that is produced in the extraction process, the higher the quality of ultimate crude oil composition that is pipelined and/or upgraded to fuel products.

Particularly effective hydrocarbons for use as the solvent according to this invention can be classified according to Hansen solubility parameters, which is a three component set of parameters that takes into account a compound's dispersion force, polarity, and hydrogen bonding force. The Hansen solubility parameters are, therefore, each defined as a dispersion parameter (D), polarity parameter (P), and hydrogen bonding parameter (H). These parameters are listed for numerous compounds and can be found in *Hansen Solubility Parameters in Practice*—Complete with software, data, and examples, Steven Abbott, Charles M. Hansen and Hiroshi Yamamoto, 3rd ed., 2010, ISBN: 9780955122026, the contents of which are incorporated herein by reference. Examples of the Hansen solubility parameters are shown in Tables 1-12.

TABLE 1

| | Hansen Parameter | | |
|---|---|---|---|
| Alkanes | D | P | H |
| n-Butane | 14.1 | 0.0 | 0.0 |
| n-Pentane | 14.5 | 0.0 | 0.0 |
| n-Hexane | 14.9 | 0.0 | 0.0 |
| n-Heptane | 15.3 | 0.0 | 0.0 |
| n-Octane | 15.5 | 0.0 | 0.0 |
| Isooctane | 14.3 | 0.0 | 0.0 |
| n-Dodecane | 16.0 | 0.0 | 0.0 |
| Cyclohexane | 16.8 | 0.0 | 0.2 |
| Methylcyclohexane | 16.0 | 0.0 | 0.0 |

TABLE 2

| | Hansen Parameter | | |
|---|---|---|---|
| Aromatics | D | P | H |
| Benzene | 18.4 | 0.0 | 2.0 |
| Toluene | 18.0 | 1.4 | 2.0 |
| Napthalene | 19.2 | 2.0 | 5.9 |
| Styrene | 18.6 | 1.0 | 4.1 |
| o-Xylene | 17.8 | 1.0 | 3.1 |
| Ethyl benzene | 17.8 | 0.6 | 1.4 |
| p-Diethyl benzene | 18.0 | 0.0 | 0.6 |

TABLE 3

| | Hansen Parameter | | |
|---|---|---|---|
| Halohydrocarbons | D | P | H |
| Chloromethane | 15.3 | 6.1 | 3.9 |
| Methylene chloride | 18.2 | 6.3 | 6.1 |
| 1,1 Dichloroethylene | 17.0 | 6.8 | 4.5 |
| Ethylene dichloride | 19.0 | 7.4 | 4.1 |
| Chloroform | 17.8 | 3.1 | 5.7 |
| 1,1 Dichloroethane | 16.6 | 8.2 | 0.4 |
| Trichloroethylene | 18.0 | 3.1 | 5.3 |
| Carbon tetrachloride | 17.8 | 0.0 | 0.6 |
| Chlorobenzene | 19.0 | 4.3 | 2.0 |
| o-Dichlorobenzene | 19.2 | 6.3 | 3.3 |
| 1,1,2 Trichlorotrifluoroethane | 14.7 | 1.6 | 0.0 |

TABLE 4

| | Hansen Parameter | | |
|---|---|---|---|
| Ethers | D | P | H |
| Tetrahydrofuran | 16.8 | 5.7 | 8.0 |
| 1,4 Dioxane | 19.0 | 1.8 | 7.4 |
| Diethyl ether | 14.5 | 2.9 | 5.1 |
| Dibenzyl ether | 17.4 | 3.7 | 7.4 |

TABLE 5

| | Hansen Parameter | | |
|---|---|---|---|
| Ketones | D | P | H |
| Acetone | 15.5 | 10.4 | 7.0 |
| Methyl ethyl ketone | 16.0 | 9.0 | 5.1 |
| Cyclohexanone | 17.8 | 6.3 | 5.1 |
| Diethyl ketone | 15.8 | 7.6 | 4.7 |
| Acetophenone | 19.6 | 8.6 | 3.7 |
| Methyl isobutyl ketone | 15.3 | 6.1 | 4.1 |
| Methyl isoamyl ketone | 16.0 | 5.7 | 4.1 |
| Isophorone | 16.6 | 8.2 | 7.4 |
| Di-(isobutyl) ketone | 16.0 | 3.7 | 4.1 |

TABLE 6

| | Hansen Parameter | | |
|---|---|---|---|
| Esters | D | P | H |
| Ethylene carbonate | 19.4 | 21.7 | 5.1 |
| Methyl acetate | 15.5 | 7.2 | 7.6 |
| Ethyl formate | 15.5 | 7.2 | 7.6 |
| Propylene 1,2 carbonate | 20.0 | 18.0 | 4.1 |
| Ethyl acetate | 15.8 | 5.3 | 7.2 |
| Diethyl carbonate | 16.6 | 3.1 | 6.1 |
| Diethyl sulfate | 15.8 | 14.7 | 7.2 |
| n-Butyl acetate | 15.8 | 3.7 | 6.3 |
| Isobutyl acetate | 15.1 | 3.7 | 6.3 |
| 2-Ethoxyethyl acetate | 16.0 | 4.7 | 10.6 |
| Isoamyl acetate | 15.3 | 3.1 | 7.0 |
| Isobutyl isobutyrate | 15.1 | 2.9 | 5.9 |

TABLE 7

| | Hansen Parameter | | |
|---|---|---|---|
| Nitrogen Compounds | D | P | H |
| Nitromethane | 15.8 | 18.8 | 5.1 |
| Nitroethane | 16.0 | 15.5 | 4.5 |
| 2-Nitropropane | 16.2 | 12.1 | 4.1 |
| Nitrobenzene | 20.0 | 8.6 | 4.1 |
| Ethanolamine | 17.2 | 15.6 | 21.3 |
| Ethylene diamine | 16.6 | 8.8 | 17.0 |
| Pyridine | 19.0 | 8.8 | 5.9 |
| Morpholine | 18.8 | 4.9 | 9.2 |
| Analine | 19.4 | 5.1 | 10 |
| N-Methyl-2-pyrrolidone | 18.0 | 12.3 | 7.2 |
| Cyclohexylamine | 17.4 | 3.1 | 6.6 |
| Quinoline | 19.4 | 7.0 | 7.6 |
| Formamide | 17.2 | 26.2 | 19.0 |
| N,N-Dimethylformamide | 17.4 | 13.7 | 11.3 |

TABLE 8

| Sulfur Compounds | Hansen Parameter D | P | H |
|---|---|---|---|
| Carbon disulfide | 20.5 | 0.0 | 0.6 |
| Dimethylsulphoxide | 18.4 | 16.4 | 10.2 |
| Ethanethiol | 15.8 | 6.6 | 7.2 |

TABLE 9

| Alcohols | Hansen Parameter D | P | H |
|---|---|---|---|
| Methanol | 15.1 | 12.3 | 22.3 |
| Ethanol | 15.8 | 8.8 | 19.4 |
| Allyl alcohol | 16.2 | 10.8 | 16.8 |
| 1-Propanol | 16.0 | 6.8 | 17.4 |
| 2-Propanol | 15.8 | 6.1 | 16.4 |
| 1-Butanol | 16.0 | 5.7 | 15.8 |
| 2-Butanol | 15.8 | 5.7 | 14.5 |
| Isobutanol | 15.1 | 5.7 | 16.0 |
| Benzyl alcohol | 18.4 | 6.3 | 13.7 |
| Cyclohexanol | 17.4 | 4.1 | 13.5 |
| Diacetone alcohol | 15.8 | 8.2 | 10.8 |
| Ethylene glycol monoethyl ether | 16.2 | 9.2 | 14.3 |
| Diethylene glycol monomethyl ether | 16.2 | 7.8 | 12.7 |
| Diethylene glycol monoethyl ether | 16.2 | 9.2 | 12.3 |
| Ethylene glycol monobutyl ether | 16.0 | 5.1 | 12.3 |
| Diethylene glycol monobutyl ether | 16.0 | 7.0 | 10.6 |
| 1-Decanol | 17.6 | 2.7 | 10.0 |

TABLE 10

| Acids | Hansen Parameter D | P | H |
|---|---|---|---|
| Formic acid | 14.3 | 11.9 | 16.6 |
| Acetic acid | 14.5 | 8.0 | 13.5 |
| Benzoic acid | 18.2 | 7.0 | 9.8 |
| Oleic acid | 14.3 | 3.1 | 14.3 |
| Stearic acid | 16.4 | 3.3 | 5.5 |

TABLE 11

| Phenols | Hansen Parameter D | P | H |
|---|---|---|---|
| Phenol | 18.0 | 5.9 | 14.9 |
| Resorcinol | 18.0 | 8.4 | 21.1 |
| m-Cresol | 18.0 | 5.1 | 12.9 |
| Methyl salicylate | 16.0 | 8.0 | 12.3 |

TABLE 12

| Polyhydric alcohols | Hansen Parameter D | P | H |
|---|---|---|---|
| Ethylene glycol | 17.0 | 11.0 | 26.0 |
| Glycerol | 17.4 | 12.1 | 29.3 |
| Propylene glycol | 16.8 | 9.4 | 23.3 |
| Diethylene glycol | 16.2 | 14.7 | 20.5 |
| Triethylene glycol | 16.0 | 12.5 | 18.6 |
| Dipropylene glycol | 16.0 | 20.3 | 18.4 |

According to the Hansen Solubility Parameter System, a mathematical mixing rule can be applied in order to derive or calculate the respective Hansen parameters for a blend of hydrocarbons from knowledge of the respective parameters of each hydrocarbon component and the volume fraction of the hydrocarbon component. Thus according to this mixing rule:

$$Dblend=\Sigma Vi\ Di,$$

$$Pblend=\Sigma Vi\ Pi,$$

$$Hblend=\Sigma Vi\ Hi,$$

where Dblend is the Hansen dispersion parameter of the blend, Di is the Hansen dispersion parameter for component i in the blend; Pblend is the Hansen polarity parameter of the blend, Pi is Hansen polarity parameter for component i in the blend, Hblend is the Hansen hydrogen bonding parameter of the blend, Hi is the Hansen hydrogen bonding parameter for component i in the blend, Vi is the volume fraction for component i in the blend, and summation is over all i components in the blend.

The solvent of this invention is defined according to the mathematical mixing rule. The solvent is comprised of a blend of hydrocarbon compounds and can optionally include limited amounts of non-hydrocarbons being optionally present. In such cases when non-hydrocarbon compounds are included in the solvent, the Hansen solubility parameters of the non-hydrocarbon compounds should also be taken into account according to the mathematical mixing rule. Thus, reference to Hansen solubility blend parameters herein, takes into account the Hansen parameters of all the compounds present. Of course, it may not be practical to account for every compound present in the solvent. In such complex cases, the Hansen solubility blend parameters can be determined according to *Hansen Solubility Parameters in Practice*. See, e.g., Chapter 3, pp. 15-18, and Chapter 8, pp. 43-46, for further description.

In order to produce a high quality crude oil composition, the solvent is selected to limit the amount of asphaltenes that are extracted from the oil sand. The more desirable solvents have Hansen blend parameters that are relatively low. Lower values for the Hansen dispersion blend parameter and/or the Hansen polarity blend parameter are particularly preferred. Especially desirable solvents have low Hansen dispersion blend and Hansen polarity blend parameters.

The Hansen dispersion blend parameter of the solvent is desirably less than 18. In general, lower dispersion blend parameters are particularly desirable. As an example, the solvent is comprised of a hydrocarbon mixture, with the solvent having a Hansen dispersion blend parameter of not greater than 16, alternatively not greater than 15, or greater than 14. Additional examples include solvents comprised of a hydrocarbon mixture, with the solvent having a Hansen dispersion blend parameter of from 13 to 16 or from 14 to 16 or from 13 to 15.

The Hansen polarity blend parameter of the solvent is desirably less than 4. In general, lower polarity blend parameters are particularly desirable. It is further desirable to use solvents that have both low Hansen dispersion blend parameters, as defined above, along with the low Hansen polarity blend parameters. As an example of low polarity blend parameters, the solvent is comprised of a hydrocarbon mixture, with the solvent having a Hansen polarity blend parameter of not greater than 2, alternatively not greater than 1, or not greater than 0.5. Additional examples include solvents comprised of a hydrocarbon mixture, with the solvent having a Hansen polarity blend parameter of from 0 to 2 or from 0 to 1.5 or from 0 to 1.

The Hansen hydrogen bonding blend parameter of the solvent is desirably less than 3. In general, lower hydrogen bonding blend parameters are particularly desirable. It is further desirable to use solvents that have low Hansen dispersion blend parameters and Hansen polarity blend parameters, as defined above, along with the low Hansen hydrogen bonding blend parameters. As an example of low hydrogen bonding blend parameters, the solvent is comprised of a hydrocarbon mixture, with the solvent having a Hansen hydrogen bonding blend parameter of not greater than 2, alternatively not greater than 1, or not greater than 0.5. Additional examples include solvents comprised of a hydrocarbon mixture, with the solvent having a Hansen hydrogen bonding blend parameter of from 0 to 2 or from 0 to 1.5 or from 0 to 1.

The solvent can be a blend of relatively low boiling point compounds. Since the solvent is a blend of compounds, the boiling range of solvent compounds useful according to this invention, as well as the crude oil compositions produced according to this invention, can be determined by batch distillation according to ASTM D86-09e1, Standard Test Method for Distillation of Petroleum Products at Atmospheric Pressure.

In one embodiment, the solvent has an ASTM D86 10% distillation point of at least −45° C. Alternatively, the solvent has an ASTM D86 10% distillation point of at least −40° C., or at least −30° C. The solvent can have an ASTM D86 10% distillation point within the range of from −45° C. to 50° C., alternatively within the range of from −35° C. to 45° C., or from −20° C. to 40° C.

The solvent can have an ASTM D86 90% distillation point of not greater than 300° C. Alternatively, the solvent has an ASTM D86 90% distillation point of not greater than 200° C., or not greater than 100° C.

The solvent can have a significant difference between its ASTM D86 90% distillation point and its ASTM D86 10% distillation point. For example, the solvent can have a difference of at least 10° C. between its ASTM D86 90% distillation point and its ASTM D86 10% distillation point, alternatively a difference of at least 20° C., or at least 30° C. However, the difference between the solvent's ASTM D86 90% distillation point and ASTM D86 10% distillation point should not be so great such that efficient recovery of solvent from extracted crude is impeded. For example, can have a difference of not greater than 60° C. between its ASTM D86 90% distillation point and its ASTM D86 10% distillation point, alternatively a difference of not greater than 50° C., or not greater than 40° C.

Solvents high in aromatic content are not particularly desirable. For example, the solvent can have an aromatic content of not greater than 15 wt %, alternatively not greater than 12 wt %, or not greater than 10 wt %. The aromatic content can be determined according to test method ASTM D6591-06 Standard Test Method for Determination of Aromatic Hydrocarbon Types in Middle Distillates-High Performance Liquid Chromatography Method with Refractive Index Detection.

Solvents high in ketone content are also not particularly desirable. For example, the solvent can have a ketone content of not greater than 20 wt %, alternatively not greater than 15 wt %, or not greater than 10 wt %. The ketone content can be determined according to test method ASTM D4423-10 Standard Test Method for Determination of Carbonyls In C4 Hydrocarbons.

The solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the solvent preferably includes not greater than 20 wt %, alternatively not greater than 10 wt %, alternatively not greater than 5 wt %, non-hydrocarbon compounds, based on total weight of the solvent injected into the extraction vessel.

Solvent to oil sand feed ratios can vary according to a variety of variables. Such variables include amount of hydrocarbon mix in the solvent, temperature and pressure of the contact zone, and contact time of hydrocarbon mix and oil sand in the contact zone. Preferably, the solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the solvent and oil sand can be supplied to the contact zone of the extraction vessel at a weight ratio of total hydrocarbon in the solvent to oil sand feed of not greater than 4:1, or 3:1, or 2:1.

IV. Vessel and Process Conditions

Extraction of oil compounds from the oil sand is carried out in a contact zone such as in a vessel having a zone in which the solvent contacts the oil sand. Any type of extraction vessel can be used that is capable of providing contact between the oil sand and the solvent such that a portion of the oil is removed from the oil sand. For example, horizontal or vertical type extractors can be used. The solid can be moved through the extractor by pumping, such as by auger-type movement, or by fluidized type of flow, such as free fall or free flow arrangements. An example of an auger-type system is described in U.S. Pat. No. 7,384,557.

The solvent can be injected into the vessel by way of nozzle-type devices. Nozzle manufacturers are capable of supplying any number of nozzle types based on the type of spray pattern desired.

The contacting of oil sand with solvent in the contact zone of the extraction vessel is at a pressure and temperature in which at least 20 wt % of the injected into the contacting zone or vessel is in vapor phase during contacting in the contacting zone or vessel. Preferably, at least 40 wt %, or at least 60 wt % or at least 80 wt % of the injected solvent is in vapor phase during contacting in the contacting zone or vessel.

Carrying out the extraction process at the desired conditions using the desired solvent enables controlling the amount of oil that is extracted from the oil sand. For example, contacting the oil sand with the solvent in a vessel's contact zone can produce a crude oil composition comprised of not greater than 80 wt %, or not greater than 70 wt %, or not greater than 60 wt %, of the bitumen from the supplied oil sand. That is, the solvent is comprised of a hydrocarbon mix or blend that has the desired characteristics such that the solvent process can remove or extract not greater than 80 wt %, or greater than 70 wt %, or greater than 60 wt %, of the bitumen from the supplied oil sand. This crude oil composition that leaves the extraction zone will also include at least a portion of the solvent. However, a substantial portion of the solvent can be separated from the crude oil composition to produce a crude oil product that can be pipelined or further upgraded to make fuel products. The separated solvent can then be recycled. Since the extraction process incorporates a relatively light solvent blend, the solvent portion can be easily recovered, with little if any external make-up being required.

The crude oil composition that includes at least a portion of the solvent, as well the crude oil product that is later separated from the crude oil composition containing solvent, will be reduced in metals and asphaltenes compared to typical processes. Metals content can be determined according to ASTM D5708-11 Standard Test Methods for Determination of Nickel, Vanadium, and Iron in Crude Oils and Residual Fuels by Inductively Coupled Plasma (ICP) Atomic Emission Spectrometry. For example, the crude oil composition that includes at least a portion of the solvent, as well the separated crude oil product, can have a nickel plus vanadium content of not greater than 150 wppm, or not greater than 125 wppm, or not greater than 100 wppm, based on total weight of the composition. As another example, the crude oil composition that includes at least a portion of the solvent, as well the separated crude oil product, can have an asphaltenes content of not greater than 15 wt %, alternatively not greater than 12 wt %, or not greater than 10 wt %, or not greater than 5 wt %.

The process is carried out at temperatures and pressures that allow at least a portion of the solvent to be maintained in the vapor phase in the contact zone. Since at least a portion of the solvent is in the vapor phase in the contact zone, higher contact zone temperatures. For example, the contacting of the oil sand and the solvent in the contact zone of the extraction vessel can be carried out at a temperature of at least 35° C., or at least 50° C., or at least 100° C., or at least 150° C. or at least 200° C. Upper temperature limits depend primarily upon physical constraints, such as contact vessel materials. In addition, temperatures should be limited to below cracking conditions for the extracted crude. Generally, it is desirable to maintain temperature in the contact vessel at not greater than 500° C., alternatively not greater than 400° C. or not greater than 300° C.

Pressure in the contact zone can vary as long as the desired amount of hydrocarbon in the solvent remains in the vapor phase in the contact zone. Atmospheric pressure and above is preferred. For example, pressure in the contacting zone can be at least 15 psia (103 kPa), or at least 50 psia (345 kPa), or at least 100 psia (689 kPa), or at least 150 psia (1034 kPa). Extremely high pressures are not preferred to ensure that at least a portion of the solvent remains in the vapor phase. For example, the contacting of the oil sand and the solvent in the contact zone of the extraction vessel can be carried out a pressure of not greater than 600 psia (4137 kPa), alternatively not greater than 500 psia (3447 kPa), or not greater than 400 psia (2758 kPa) or not greater than 300 psia (2068 kPa).

V. Separation and Recycle of Solvent

The crude oil composition that is removed from the contact zone of the extraction vessel comprises the oil component extracted from the oil sand and at least a portion of the solvent. At least a portion of the solvent in the oil composition can be separated and recycled for reuse as solvent. This separated solvent is separated so as to match or correspond to the Hansen solubility characteristics, overall generic chemical components and boiling points as described above for the solvent composition. For example, an extracted crude product containing the extracted crude oil and solvent is sent to a separator and a light fraction is separated from a crude oil fraction in which the separated solvent has each of the Hansen solubility characteristics and each of the boiling point ranges within 20% of the above noted amounts, alternatively within 10% of the above noted amounts. This separation can be achieved using any appropriate chemical separation process. For example, separation can be achieved using any variety of evaporators, flash drums or distillation equipment or columns. The separated solvent can be recycled to contact oil sand, and optionally mixed with make-up solvent having the characteristics indicated above.

Following removal of the crude oil composition from the extraction vessel, the crude oil composition is separated into fractions comprised of recycle solvent and crude oil product. The crude oil product can be relatively high in quality in that it can have relatively low metals and asphaltenes content as described above. The low metals and asphaltenes content enables the crude oil product to be relatively easily upgraded to liquid fuels compared to typical bitumen oils.

The crude oil product can also have a relatively high API gravity compared to bitumen oils extracted according to typical processes. API gravity can be determined according to ASTM D287-92(2006) Standard Test Method for API Gravity of Crude Petroleum and Petroleum Products (Hydrometer Method). The crude oil product can, for example, have an API gravity of at least 8, or at least 10, or at least 12, depending on the exact solvent composition and process conditions. This relatively high API gravity enables the crude product to be relatively easily pipelined.

VI. Examples

Table 13 shows the results of performed experiments and obtained data. For experiments 2125 and 2127, the following procedure was carried out: 200 grams of an Athabasca tar sands ore sized between 12 and 16 mesh was stirred with 100 grams of solvent for two minutes at 69-70 F. The mixture was filtered and the solids treated with a second amount of 100 grams of solvent. The mixture was again filtered and the liquids from the two steps were combined. The solvent was allowed to weather off. Samples were sent for analysis (Intertek, New Orleans). API gravity measured by ASTM D-5002. % MCRT measured by ASTM D-4530. Ni and V in ppm by ASTM D-5708_MOD. Wt. % Sulfur by ASTM D4294.

Sample 2043 was obtained as the liquid product from a propane extraction of the same Athabasca ore as for 2125 and 2127. Experiment 2043 was run in a continuous manner using an auger system to provide constant agitation of solid particles. Temperature within the auger was about 80-90 F and the total pressure in the system was approximately 150 psi. The liquid product was collected and propane was weathered off prior to analysis.

The comparative example of the water solvent (Clark process) was taken from the literature. (www.etde.org/etdeweb/serviets/pur1/21239492-3CCEvD/). The asphaltene analysis is believed to be a measurement of pentane insolubles by ASTM D-664.

TABLE 13

| Solvent Type | API ° Gravity | % MCRT | wppm Ni + V | Wt. % Sulfur |
|---|---|---|---|---|
| Pentane (2125) | 12.9 | 6.2 | 92 | 2.9 |
| 30/70 Acetone/ Pentane (2127) | 11.6 | 8.6 | 167 | 3.0 |
| Propane (2043) | 17.0 | 2.4 | 8.3 | 3.2 |
| Water (Clark Process) | ~8 | 14.1% (Asphaltenes) | 431 | 5.7 |

Table 14 shows the Hansen shows the Hansen solubility blend parameters of the solvents of Table 13.

TABLE 14

| Solvent | Hansen Parameter D | P | H |
|---|---|---|---|
| Propane | 13.1 | 0.0 | 0.0 |
| Pentane | 14.5 | 0.0 | 0.0 |
| 30 Acetone/70 Pentane | 14.8 | 3.1 | 2.1 |
| Water | 15.5 | 16 | 42.3 |

Solvents that are comprised of blends of hydrocarbons would be particularly advantageous in that such solvents can be more readily obtained. Blends that can produce higher quality crude oils are preferred, e.g., blends that produce crude oils having low metals and asphaltenes contents. Thus, particularly desired solvents that comprise blends of hydrocarbons would have a Hansen dispersion blend parameter of not greater than 16 and/or a Hansen polarity blend parameter of not greater than 2.5, preferably not greater than 2. Especially desired solvents that comprise blends of hydrocarbons would have a Hansen dispersion blend parameter of not greater than 16 and a Hansen polarity blend parameter of not greater than 2.5, preferably not greater than 2. In addition, solvents further including a Hansen hydrogen bonding blend parameter of not greater than 2 are particularly preferred.

The principles and modes of operation of this present techniques have been described above with reference to various exemplary and preferred embodiments. As understood by those of skill in the art, the overall present techniques, as defined by the claims, encompasses other preferred embodiments not specifically enumerated herein.

The invention claimed is:

1. A partial extraction process for producing a high quality crude oil composition from oil sand, comprising:

a) supplying oil sand containing bitumen to a contact zone of an extraction vessel, wherein the oil sand supplied to the contact zone has an average particle size of not greater than 20,000 microns and the bitumen is comprised of a flowable oil component, volatile hydrocarbons and asphaltene;

b) moving the particles of oil sand through the contact zone of the extraction vessel;

c) injecting a solvent blend into the extraction vessel, wherein the solvent blend has the following properties:

(i) is a hydrocarbon mixture comprised of at least two hydrocarbons selected from the group consisting of propane, butane and pentane, (ii) has a Hansen dispersion blend parameter of not greater than 15, (iii) has a Hansen polarity blend parameter of not greater than 1, (iv) has a Hansen hydrogen bonding blend parameter of not greater than 1, (v) has an ASTM D86 10% distillation point within the range of from −45'C to 50° C., and (vi) has an ASTM D86 90% distillation point of not greater than 300° C.;

d) treating the oil sand particles moving through the contact zone of the extraction vessel in step b) with the solvent blend in the contact zone of the extraction vessel as a vapor phase treatment, wherein (i) not greater than 80 wt % of the bitumen is extracted from the supplied oil sand to produce an extracted crude oil composition and treated oil sand, with the treated oil sand containing unextracted bitumen comprised of asphaltenes, (ii) the contact zone is at a temperature and pressure in which at least 20 wt % of the solvent injected into the extraction vessel is in vapor phase during treatment of the particles of oil sand with the solvent in the contact zone of the extraction vessel, with the contact zone temperature being at least 35° C., and (iii) no water is used in extracting the crude oil composition;

e) removing the extracted crude oil composition from the extraction vessel, wherein the extracted crude oil composition comprises the high quality crude oil product and at least a portion of the solvent injected into the extraction vessel; and f) separating at least a portion of the solvent from the extracted crude oil composition removed from the extraction vessel in step e) to recover the high quality crude oil product and a recycle solvent, wherein (i) the high quality crude oil product is defined as having a nickel plus vanadium content of not greater than 100 wppm, an asphaltene content of not greater than 5 wt % and an API gravity of at least 12, and (ii) the recycle solvent has each of the Hansen solubility characteristics and each of the distillation point ranges within 20% of the solvent properties defined in step c).

2. The process of claim 1, wherein the contacting of the the oil sand particles and the solvent in the contact zone of the extraction vessel is at a pressure of not greater than 600 psia (4137 kPa).

3. The process of claim 1, wherein the solvent has a difference of at least 10° C. between its ASTM D86 90% distillation point and its ASTM D86 10% distillation point.

4. The process of claim 1, wherein the solvent has an ASTM D86 10% distillation point of at least −45° C. and an ASTM D86 90% distillation point of not greater than 300° C., with the ASTM D86 10% distillation point and the ASTM D86 90% distillation point having a difference of not greater than not greater than 60° C.

5. The process of claim 1, wherein the solvent has a difference of not greater than 50° C. between the ASTM D86 90% distillation point and the ASTM D86 10% distillation point.

6. The process of claim 1, wherein the solvent has an aromatic content of not greater than 10 wt %.

7. The process of claim 1, wherein the solvent has a ketone content of not greater than 10 wt %.

8. The process of claim 1, wherein the oil sand particles are moved through the contact zone of the extraction vessel in step b) by pumping.

9. The process of claim 8, wherein the oil sand particles are pumped through the contact zone of the extraction vessel by auger movement.

10. The process of claim 8, wherein the oil sand particles are pumped through the contact zone of the extraction vessel by fluidized flow.

11. The process of claim 1, wherein the solvent blend is injected into the extraction vessel by a nozzle arrangement.

* * * * *